US005805045A

United States Patent [19]

Henninger

[11] Patent Number: 5,805,045

[45] Date of Patent: Sep. 8, 1998

[54] POWER SUPPLY CONDUCTOR FROM A CONDUCTIVE FOIL OF A FOIL WINDING OF A POWER TRANSFORMER

[75] Inventor: Peter Henninger, Erlangen, Germany

[73] Assignee: Siemens Aktiengesellschaft, Munich, Germany

[21] Appl. No.: 809,332

[22] PCT Filed: Sep. 8, 1995

[86] PCT No.: PCT/DE95/01230

§ 371 Date: Mar. 20, 1997

§ 102(e) Date: Mar. 20, 1997

[87] PCT Pub. No.: WO96/09631

PCT Pub. Date: Mar. 28, 1996

[30] Foreign Application Priority Data

Sep. 21, 1994 [DE] Germany ..... 44 33 700.0

[51] Int. Cl.[6] ..... H01F 27/29; H01F 27/28; H01F 5/00

[52] U.S. Cl. ..... 336/192; 336/200; 336/223

[58] Field of Search ..... 336/192, 223, 336/200

[56] References Cited

U.S. PATENT DOCUMENTS

| | | | |
|---|---|---|---|
| 1,160,357 | 11/1915 | Agnew | 336/223 |
| 2,378,884 | 6/1945 | Seifert | 336/223 |
| 2,961,747 | 11/1960 | Lyman | 336/223 |

FOREIGN PATENT DOCUMENTS

| | | |
|---|---|---|
| 911 292 | 5/1954 | Germany . |
| 19 63 858 | 4/1967 | Germany . |
| 19 08 165 | 10/1970 | Germany . |

OTHER PUBLICATIONS

*Engineers' Digest,* Bd. 28, No. 12, (Dec. 1967), London, England, p. 99.

*Electrical Equipment,* "Al Alloys for foil–wound coils", (Jul./Aug. 1974), pp. 60–62 (Based on a paper presented at Coilwinding Int'l '74 Convention, London, England by H. Witzig and D.A. Bennett).

*Journal de l'équipment électrique et électronique,* No. 295 (Nov. 1969), p. 123.

*Primary Examiner*—Michael L. Gellner
*Assistant Examiner*—Anh Mai
*Attorney, Agent, or Firm*—Kenyon & Kenyon

[57] ABSTRACT

The power supply conductor of a power transformer with foil winding is formed with a plurality of flag-shaped end pieces at one end due to slots running in the longitudinal direction of the foil, which flag-shaped end pieces are folded to form a stack kinked in relation to the longitudinal direction of the foil. The flag-shaped, folded end pieces of the conductor stack must be insulated at least in the area of the edge of the unslotted foil from one another, for example, using insulating foils.

13 Claims, 4 Drawing Sheets

POWER SUPPLY CONDUCTOR FROM A CONDUCTIVE FOIL OF A FOIL WINDING OF A POWER TRANSFORMER

FIELD OF THE INVENTION

The invention concerns a laminated power supply conductor of a power transformer with an air-cooled foil winding wound from a strip-shaped conductive foil, whose foil end forms a plurality of flag-type end pieces due to slots running in the longitudinal direction of the foil, which end pieces are folded into a power supply conductor stack excentric in relation to the longitudinal direction of the foil.

BACKGROUND INFORMATION

A conventional power supply conductor is described in an article "Electrical Equipment".

In air-cooled power transformers with a high rate of utilization, with low-voltage windings made of strip-shaped conductive foils, the power supply conductors, connected to the conductive foil of the winding in a connection area, can often be overheated. In a conventional embodiment of such a power transformer, conductive buses are provided as power supply conductors, onto which the conductive foil of the low-voltage winding is welded laterally. A current diversion arises freely in the foil according to the induced voltages and resistance conditions. This results in an exponential drop in the power supply conductor current, in the direction of the current from the bus to the foil, and from the first connecting point (corner) of the foil with the bus to the opposite corner of the foil. This causes high current densities to appear in the first corner of the foil, which result in high local thermal stresses. The more distant half of the bus no longer carries useful current due to the exponential drop in the power supply conductor bus current; this means that it no longer contributes appreciably to current transport in the foil. Only eddy currents are induced in the more distant half of the conductor bus, resulting in additional losses. Especially high eddy currents are induced in the power supply buses at the winding edges due to the foil winding. Here the foil winding has considerably increased current densities due to the current displacement effect. The increased amperage in the foil winding induces eddy currents in the cross section plane of the power supply buses and thus additional losses. If, in the case of transformers with a high degree of utilization, the sum of losses in the power supply conductors' area becomes excessive, a solution to this problem is sought by modifying the conducting cross section or the electric conductance through the use of another material or by improving cooling. Combined measures are also used for this purpose.

The "Electrical Equipment" article describes that for power transformers with foil windings that the foil end is subdivided into a plurality of flag-like end pieces in a connection area using slots running in the longitudinal direction of the conductive foil, which are kinked or folded in a right angle so that the flag-like end pieces form a stack of the laminated power supply conductor. Other specific embodiments of such a laminated power supply conductor are not found in the above-cited literature. It must be assumed that considerable eddy current losses arise even in such a laminated power supply conductor.

Therefore, the object of the present invention is to improve the conventional power supply conductor so that eddy current losses in its laminated stack are further reduced.

SUMMARY OF THE INVENTION

This object is achieved according to the present invention by insulating the flag-like folded end pieces of the conductor stack at least in the area of the winding edge of the unslotted foil portion.

With this measure, eddy currents can be suppressed to a high degree in the cross section plane of the power supply conductor. Namely, it is recognized that the danger of eddy current formation is particularly high exactly in the edge area of the unslotted foil portion. The flag-like end pieces need to be insulated from one another and guided only a few centimeters outward from the line of the extended longitudinal side of the unslotted foil portion; an insulation of the flag-like end pieces is not needed further outward (outside the foil winding area) and these end pieces can be continued without insulation or as a solid power supply bus.

DETAILED DESCRIPTION OF THE INVENTION

In order to effectively reduce the power loss in a power supply conductor and the respective connecting foil of the foil winding of a power transformer, the cross section of the power supply conductor is laminated and its length is shortened to an electrically effective length. In addition, controlled power supply to the connecting foil reduces the maximum current densities that arise in the winding foil; thus the losses in the connecting area of the foil are also reduced.

The design of a power supply conductor is based on the measures described in the article "Electrical Equipment," namely to shape the ends of a strip-shaped conductive foil of a foil winding into a plurality of flag-like end pieces, which then provide a power supply conductor stack with the required electrical cross section surface by successive folding as shown in FIGS. 1–5. The steps described below show the construction of such a power supply conductor.

Figure 1:
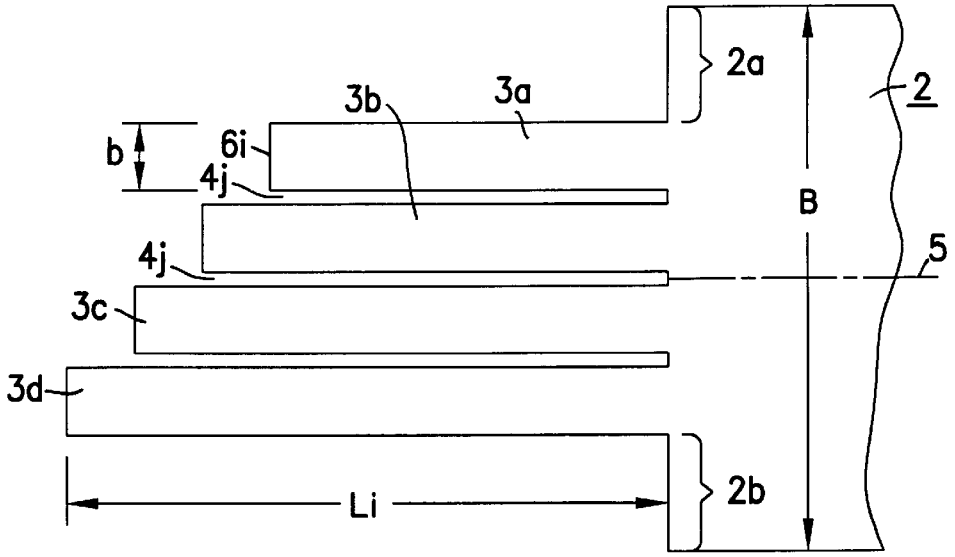
FIG. 1 shows a first successive progression of a power supply conductor construction according to the present invention for a power transformer.

FIG. 1 shows the end of strip-shaped conductive foil 2, with a width B. This conductive foil represents the connecting foil of a foil winding and continues as a plurality of (e.g., four) flag-shaped end pieces 3*i* (with i=a, b, c, or d), which are advantageously separated from one another by narrow slots 4*j*. According to an embodiment of the present invention, all flag-shaped end pieces 3*i* have approximately the same width b. They may, however, also have different widths. Width b of end pieces 3*i* are preferably selected so that front edge zones 2*a* and 2*b* of connecting foil 2 remain free. In addition, flag-like end pieces 3*i* can be advantageously designed to be symmetrical in relation to the extended centerline 5 of connecting foil 2. Length Li of the individual end pieces 3i can be selected so that after folding, the front ends 6*i* of end pieces 3*i* form a common front of a stack of the power supply conductor.

As illustrated in FIG. 1 the shortest end piece 3*a* is the first to be folded and also the first, seen in the direction of the current, that allows the current to pass from the power supply conductor to connecting foil 2. FIG. 1 shows that it is the "uppermost" end piece.

Figure 2:
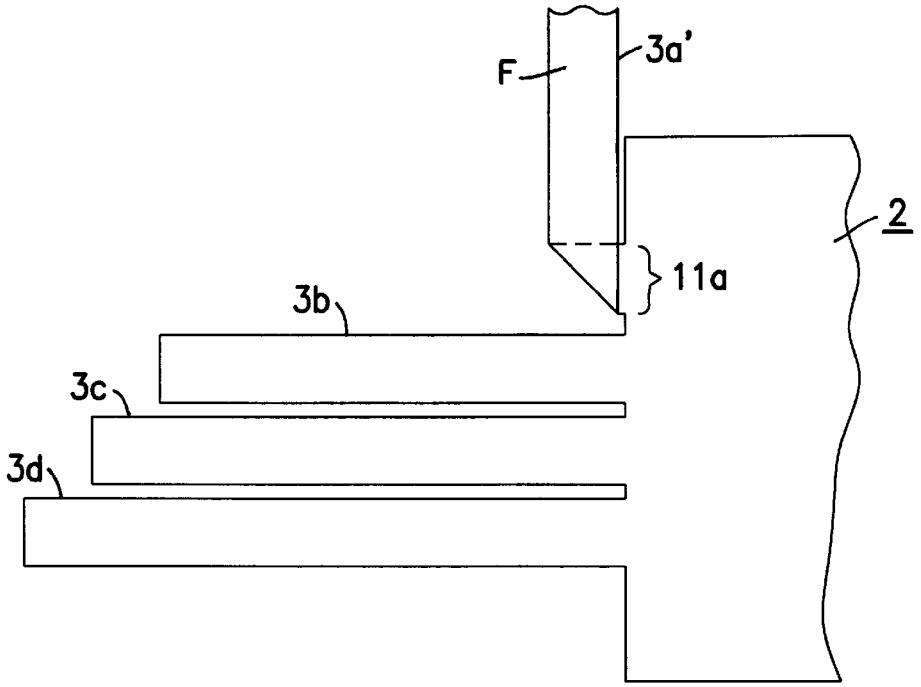
FIG. 2 shows a second successive progression of the power supply conductor construction according to the present invention for a power transformer.
Figure 3:
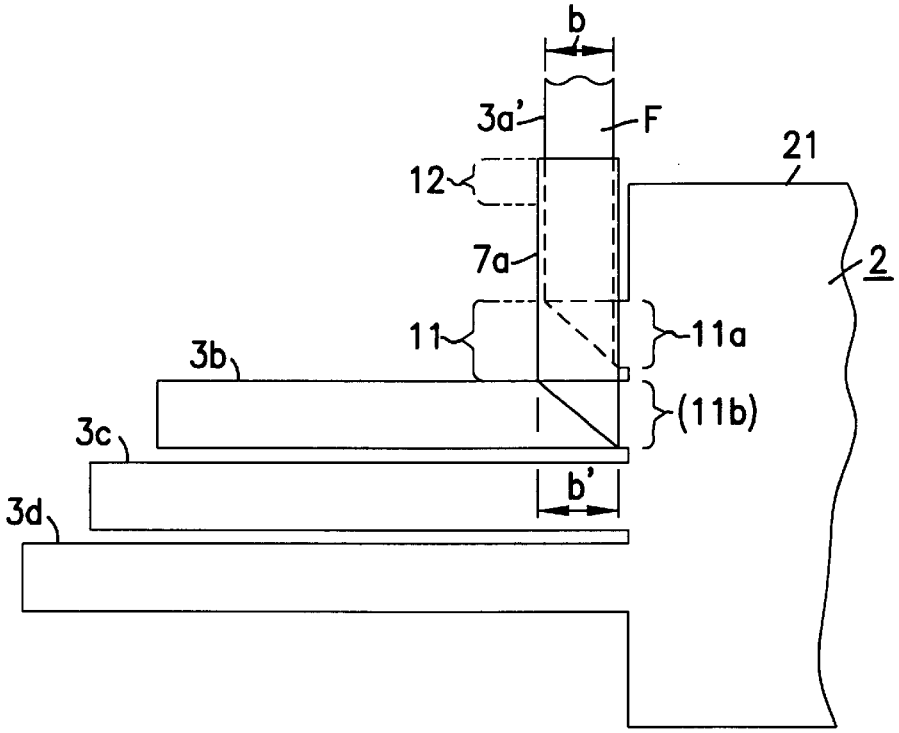
FIG. 3 shows a third successive progression of the power supply conductor construction according to the present invention for a power transformer.

This uppermost end piece 3*a* is folded, as shown in FIG. 2, upward with a 90° kink, forming a folding area 11*a*. This end piece is then denoted as 3*a'* , according to the present invention, and should be at least partially insulated on its upper flat face F where the next flag-shaped end piece (3*b*) should subsequently lie. (The folded end pieces are hereinafter denoted with an added "'". In addition, this flat face F can be covered with an insulating foil 7*a* according to FIG. 3. The insulating foil can have a somewhat greater width b' than the corresponding flag-shaped end piece 3*a'*, as shown in FIG. 3; widths b and b' of insulation foil 7*a* and end piece 3*a'* can, however, also be the same. Insulation foil 7*a* must at least cover an area 12 around the extended lateral edge 21 of connecting foil 2 (or its extended lateral longitudinal edge). Advantageously both lateral edges of area 12 are located a few centimeters from the extended lateral edge 21. In addition, insulation foil 7 advantageously extends up to and including folding area 11*a* of end piece 3*a,* and preferably beyond it, covering also folding area 11*b* of the next end piece (3*b*). The underside of end piece 3*a'* can optionally be provided with an insulating foil 7*a* at least in its folding area 11*a*.

Figure 4:
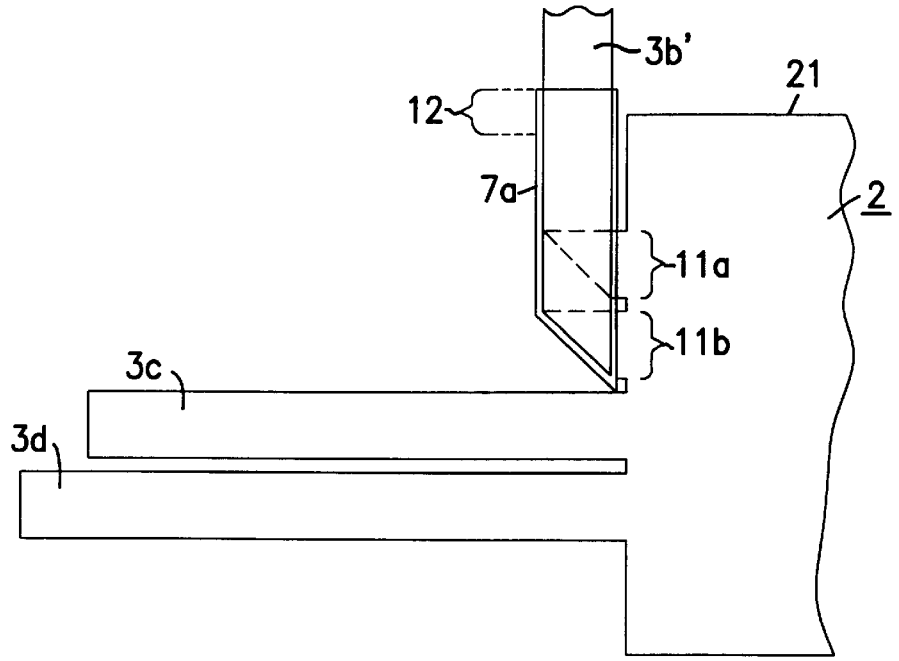
FIG. 4 shows a fourth successive progression of the power supply conductor construction according to the present invention for a power transformer.
Figure 5:
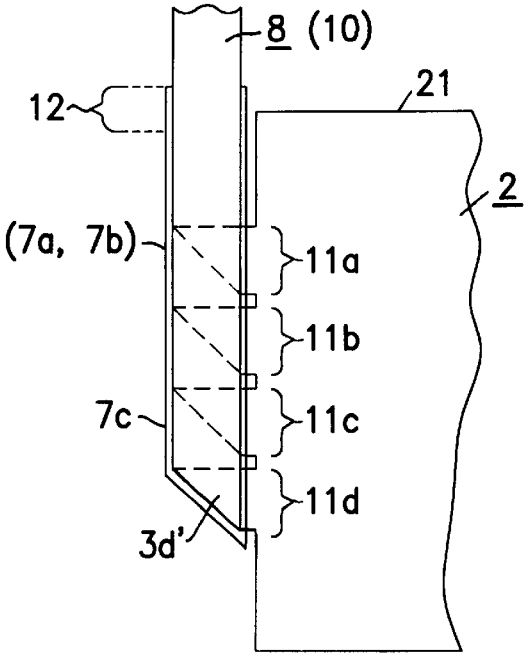
FIG. 5 shows a fifth successive progression of the power supply conductor construction according to the present invention for a power transformer.

As shown in to FIG. 4 the second flag-shaped end piece 3*b* is then folded upward, so that both end pieces 3*a'* and 3*b'*, together with their insulation foil 7*a* overlap to cover the same area. They are then insulated as shown in FIG. 3.

Folding flag-like end pieces 3*i* in their respective folding areas (11*a* through 11*d*) and their insulation from one another continue until all end pieces on top of one another form a stack 10, kinked in relation to the longitudinal direction of the foil, of a laminated power supply conductor 8. An insulating foil (7*a* through 7*c*) is located between each pair of individual flag-like end pieces 3*i'*, at least in the edge area 12, but advantageously also up to the respective folding areas (11*a* through 11*d*), so that the end pieces are electrically insulated from one another. Thus the eddy currents can be effectively suppressed in the cross section area of power supply conductor 8.

Flag-like end pieces 3*i* must be insulated from one another only for a few centimeters outside edge area 12 of the foil winding; then the insulation between the end pieces can be omitted and these may continue without insulation or as a solid power supply bus.

The division of the full conductor current to the individual flag-shaped end pieces is influenced by the different lengths and therefore the different electrical resistances of the respective end pieces, as well as by the different axial connecting positions of the end pieces to the connecting foil. These connecting positions determine the different flux linkages of the foil over the winding height and thus the induced voltage. The flux linkage in the axial center of the foil is higher than on the upper and lower edges of the foil.

Figure 6:
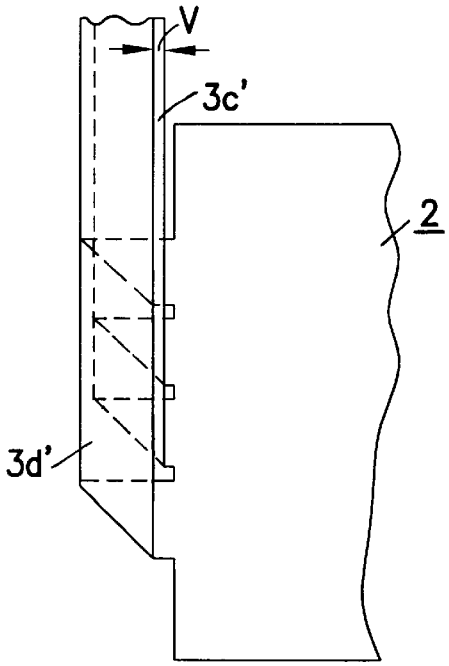
FIG. 6 shows another embodiment of a power supply conductor according to the present invention.

The natural uneven distribution of the overall conductor current to the individual flag-shaped end pieces 3*i'* can be advantageously influenced by small shifts of the end pieces in the peripheral direction, i.e., in the extended longitudinal direction of connecting foil 2, to modify the induced voltage. FIG. 6 shows such a shift v of flag-shaped end pieces 3*d'* and 3*c'* of FIGS. 1 through 5. The mutual shift of the end pieces in the longitudinal direction of foil 2 is on the order of a millimeter and depends on the winding voltage of the respective foil transformer. In general the lateral shift is a few mm at maximum. This allows the current distribution to be evened out among the individual flag-shaped end pieces. Of course, the other flag-shaped end pieces can be shifted in a similar manner.

Figure 7:
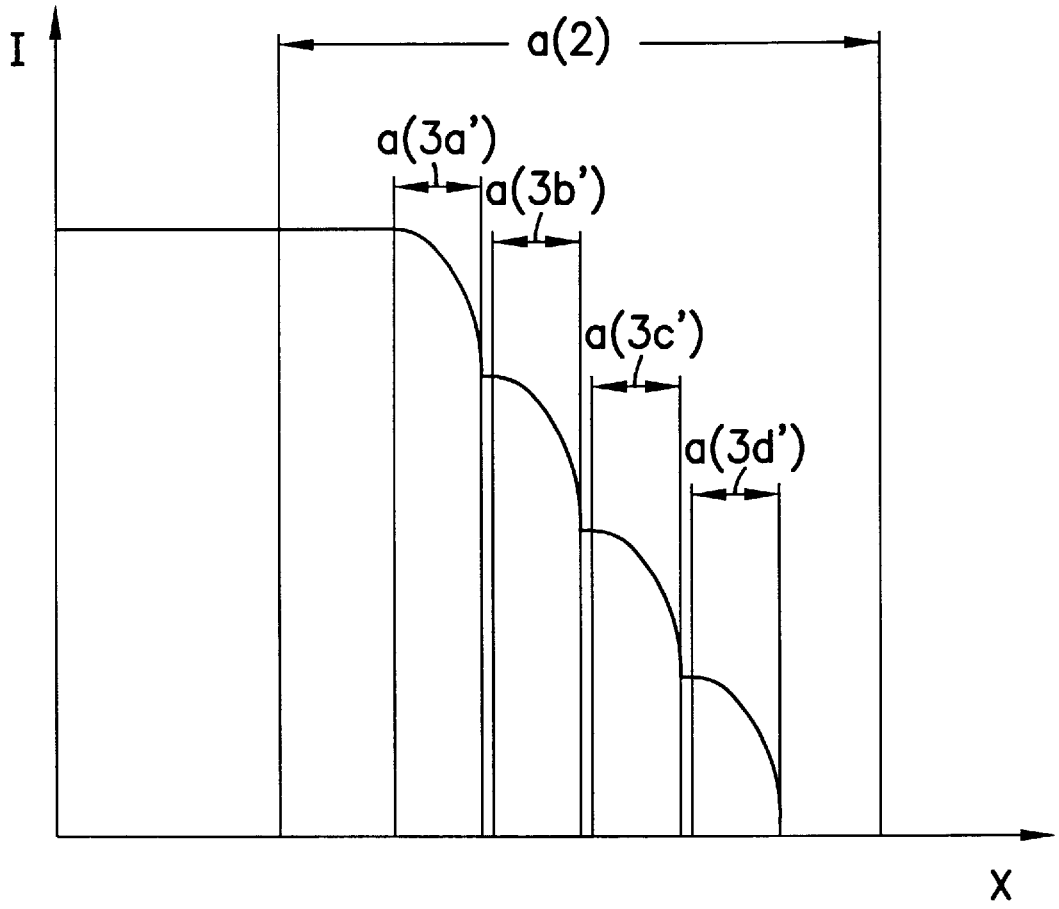
FIG. 7 shows the current drop in a power supply conductor according to the present invention as a diagram.

With a power supply conductor as illustrated in FIGS. 1–6, controlled current drop in the power supply conductors of a power transformer and thus an even current supply to a connecting foil of a low-voltage winding can be achieved. FIG. 7 shows the diagram of such a current drop. Current I in the power supply conductor at its foil end is plotted against its length x, both in arbitrary units. Lengths a (3*i'*) of flag-shaped end pieces 3*i'* are marked by the reference symbols of the respective end pieces. Length a(2) of the area of connecting foil 2 of the low-voltage winding is marked in a similar manner. The curve shows the controlled, relatively even current drop at the end of the power supply conductor. Thus excessive current densities in the connecting foil and the resulting losses are advantageously avoided.

According to the embodiments illustrated, it is assumed that the individual folded end pieces 3*i'* are insulated from one another using insulating foils. Of course, other insulation method can also be used. Thus, for example, the individual end pieces can be provided with insulating layers before or after folding.

Furthermore, a symmetrical arrangement of flag-shaped end pieces 3*i* in relation to the imaginary foil centerline 5 is illustrated in FIG. 1. However, an asymmetrical arrangement is also possible. This results in the advantage of shorter conductors and thus lower losses when the current distribution is uneven. Any uneven distribution problems can, however, be alleviated through the lateral shifts shown in FIG. 6.

Unequal widths of the individual flag-shaped end pieces 3*i* are also possible in principle and can be advantageously combined with the aforementioned lateral shift measures. A lateral shift can, for example, occur later if material is removed on the left- and/or right-hand longitudinal edges of the end pieces.

The measures according to the present invention basically refer to the embodiment of a power supply conductor of a power transformer with foil winding. Similar power transformers are known in principle, so that they are not explicitly illustrated in the drawings.

I claim:

1. A laminated power supply conductor of a power transformer, the supply conductor comprising:

a strip-shaped conductive foil having an end including a plurality of flag-shaped end pieces, the end pieces being folded to form a conductor stack, the conductive foil further having an edge;

wherein one of the folded end pieces of the conductor stack is insulated by an insulator from another one of the folded end pieces at least in a predetermined area of the one of the folded end pieces, the predetermined area being proximate to the edge of the conductive foil.

2. The power supply conductor according to claim 1, wherein the insulator is an insulating foil.

3. The power supply conductor according to claim 1, wherein, before being folded, the end pieces are symmetrically positioned relative to a centerline of the conductive foil.

4. The power supply conductor according to claim 1, wherein the end pieces have the same width.

5. The power supply conductor according to claim 1, wherein a first one of the end pieces has a first length and a consecutive one of the end pieces has a second length, the first length being shorter than the second length so that after being folded, the end faces of the end pieces form a common front face of the power supply conductor.

6. The power supply conductor according to claim 1, wherein the folded end pieces arranged in the stack substantially overlap each other.

7. The power supply conductor according to claim 1, wherein the end pieces are folded so that a first one of the end pieces is laterally shifted relative to a second one of the end pieces in the conductor stack.

8. The power supply conductor according to claim 7, wherein the first and second end pieces are laterally shifted relative to each other by a distance equal to or less than two millimeters.

9. The power supply conductor according to claim 1, wherein the folded end pieces are insulated from one another to reduce eddy current in the conductor stack.

10. A foil winding comprising:

a laminated power supply conductor including:

a strip-shaped conductive foil having an end including a plurality of flag-shaped end pieces, the end pieces being folded to form a conductor stack, the conductive foil further having an edge;

wherein one of the folded end pieces of the conductor stack is insulated by an insulator from another one of the folded end pieces at least in a predetermined area of the one of the folded end pieces, the predetermined area being proximate to the edge of the conductive foil.

11. The foil winding according to claim 10, wherein the folded end pieces are insulated from one another to reduce eddy current in the conductor stack.

12. A power transformer having a foil winding comprising:

a laminated power supply conductor including:

a strip-shaped conductive foil having an end including a plurality of flag-shaped end pieces, the end pieces being folded to form a conductor stack, the conductive foil further having an edge;

wherein one of the folded end pieces of the conductor stack is insulated by an insulator from another one of the folded end pieces at least in a predetermined area of the one of the folded end pieces, the predetermined area being proximate to the edge of the conductive foil.

13. The power transformer according to claim 12, wherein the folded end pieces are insulated from one another to reduce eddy current in the conductor stack.

* * * * *